US010809041B1

(12) United States Patent
Weigel

(10) Patent No.: US 10,809,041 B1
(45) Date of Patent: Oct. 20, 2020

(54) REACTIVE FIREARM TARGET

(71) Applicant: Ezra Luke Weigel, Lafayette, CO (US)

(72) Inventor: Ezra Luke Weigel, Lafayette, CO (US)

( * ) Notice: Subject to any disclaimer, the term of this patent is extended or adjusted under 35 U.S.C. 154(b) by 0 days.

(21) Appl. No.: 16/427,079

(22) Filed: May 30, 2019

(51) Int. Cl.
*F41J 5/24* (2006.01)

(52) U.S. Cl.
CPC ..... *F41J 5/24* (2013.01)

(58) Field of Classification Search
CPC ..... F41J 5/24–26
USPC ..... 273/380
See application file for complete search history.

(56) References Cited

U.S. PATENT DOCUMENTS 3,396,971 A * 8/1968 Estep ..... F41J 3/0004 273/403
3,473,650 A * 10/1969 Hoag ..... B65D 83/06 383/200
4,243,228 A * 1/1981 Marcella ..... F41J 5/24 273/363
4,498,677 A * 2/1985 Dapkus ..... F41J 5/24 102/335
9,958,239 B1 * 5/2018 Snell ..... F41J 5/24
10,386,161 B1 * 8/2019 Snell ..... F41J 5/24
2007/0063445 A1 * 3/2007 Tierney ..... F41J 1/10 273/359
2011/0316234 A1 * 12/2011 Miller, Sr. ..... F41J 5/24 273/380
2013/0009364 A1 * 1/2013 Forness ..... F41J 5/24 273/383
2016/0010958 A1 * 1/2016 Lessnick ..... F41J 5/24 434/19

OTHER PUBLICATIONS

Smoke 'Em Targets, smokeemtargets.com, archived Aug. 10, 2013, and Sep. 21, 2013 (Year: 2013).*

* cited by examiner

*Primary Examiner* — Laura Davison
(74) *Attorney, Agent, or Firm* — Plager Schack LLP; Mark H. Plager; Michael J. O'Brien

(57) ABSTRACT

A reactive firearm target configured to release a visible airborne signature upon a ballistic impact. The reactive firearm target includes a main body further comprising a main body upper opening and a main body lower opening. An upper target insert is inserted into the main body upper opening. A lower target insert is inserted into the main body lower opening. The ballistic impact of either the upper target insert the lower target insert causes the release of the visible airborne signature.

7 Claims, 4 Drawing Sheets

REACTIVE FIREARM TARGET

BACKGROUND

The embodiments herein relate generally to firearm accessories. Prior to embodiments of the disclosed invention, conventional paper, metal, self-healing rubberized and foam firearm targets conveyed only a minimal report or reaction upon impact. A target's failure to amplify shot placement required the need for post inspection of the target. A further issue with standard targets was that they are limited to a single user, this prevented simultaneous engagement by multiple participants in training scenarios. Embodiments of the disclosed invention solve these problems.

SUMMARY

A reactive firearm target configured to release a visible airborne signature upon a ballistic impact. The reactive firearm target includes a main body further comprising a main body upper opening and a main body lower opening. An upper target insert is inserted into the main body upper opening. A lower target insert is inserted into the main body lower opening. The ballistic impact of either the upper target insert the lower target insert causes the release of the visible airborne signature.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
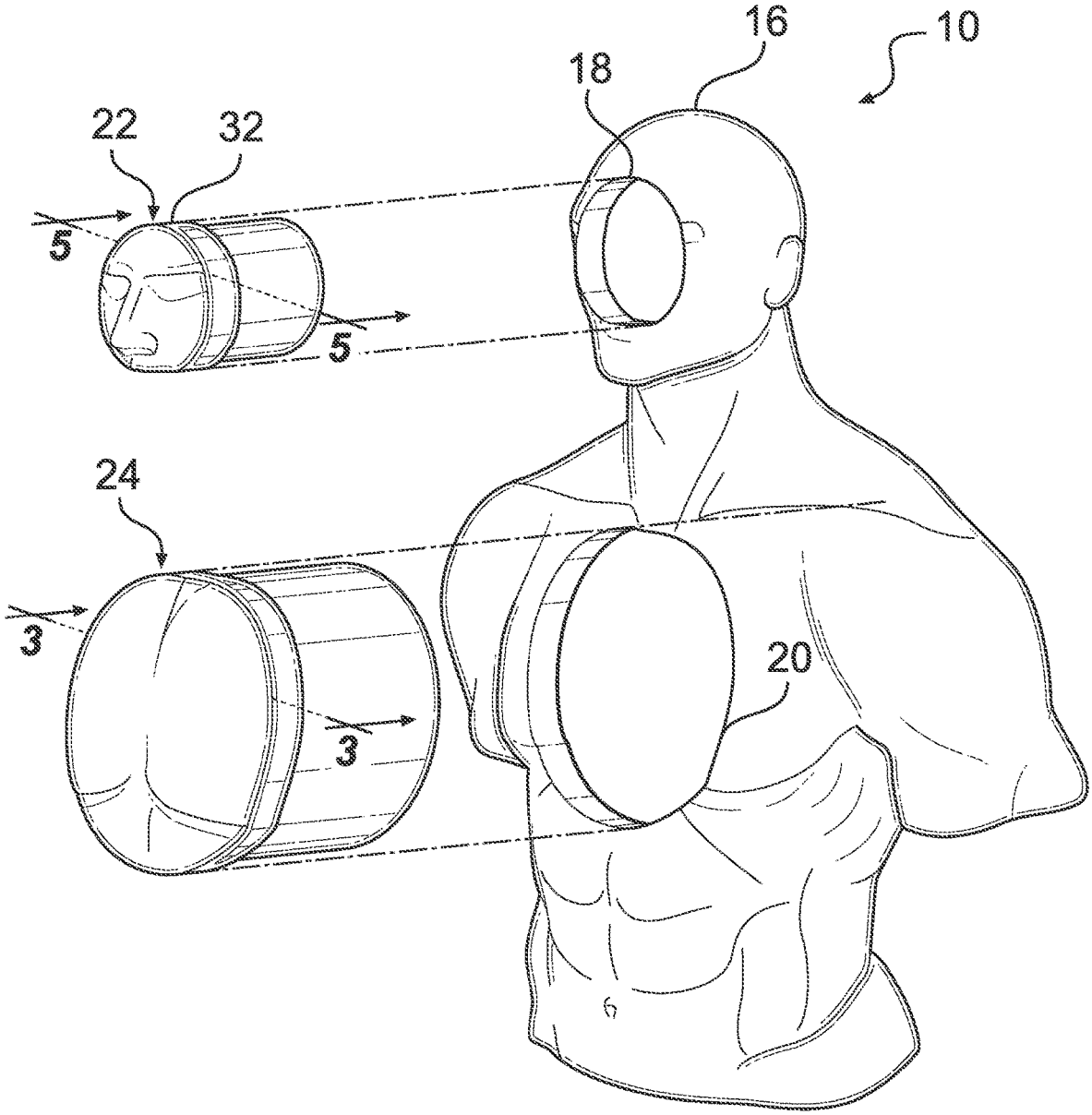
FIG. 1 shows a perspective exploded view of a reactive firearm target.
Figure 2:
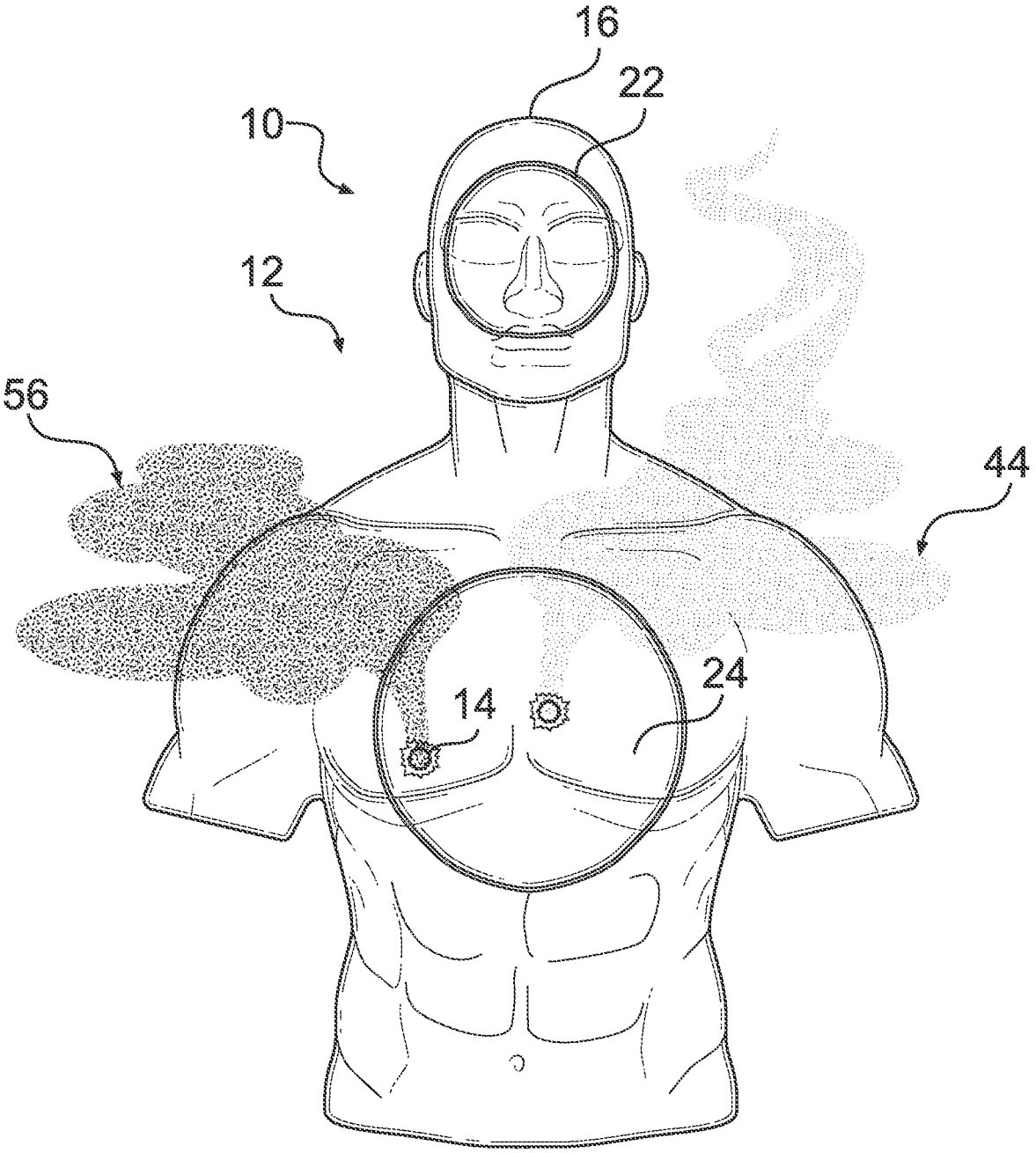
FIG. 2 is front assembled in use view of a reactive firearm target.
Figure 3:
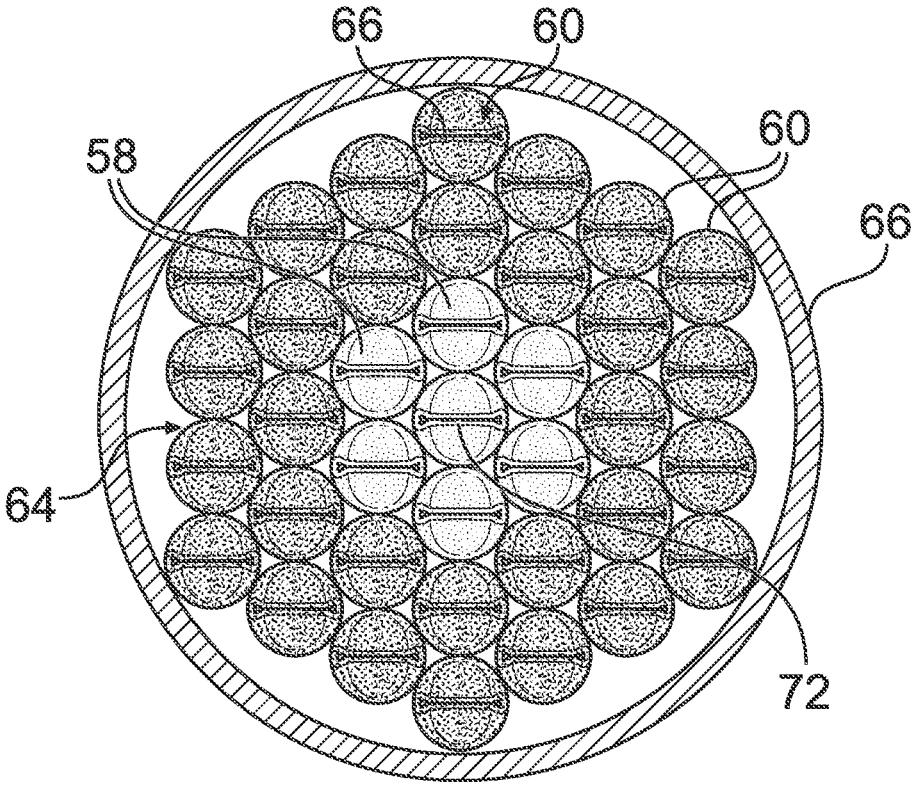
FIG. 3 is a cross sectional view of the chest target insert and foam cover.
Figure 4:
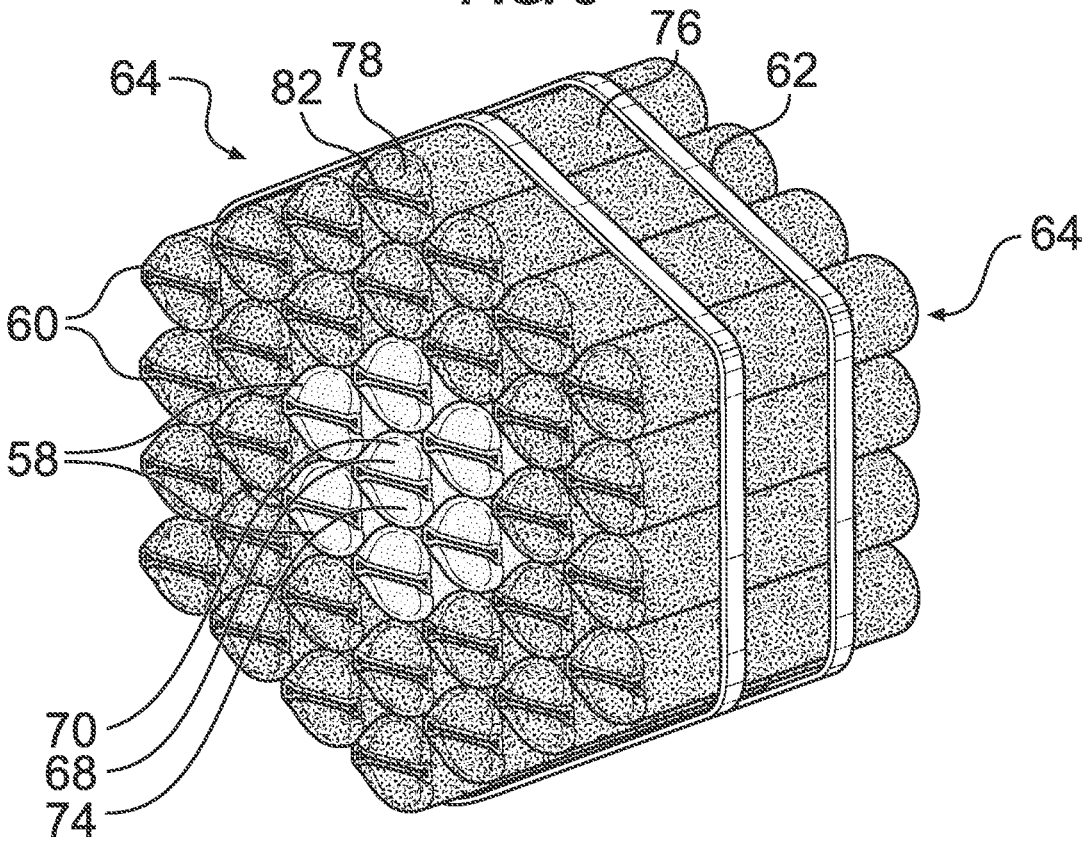
FIG. 4 is a perspective view of the chest target insert in isolation from the foam cover.
Figure 5:
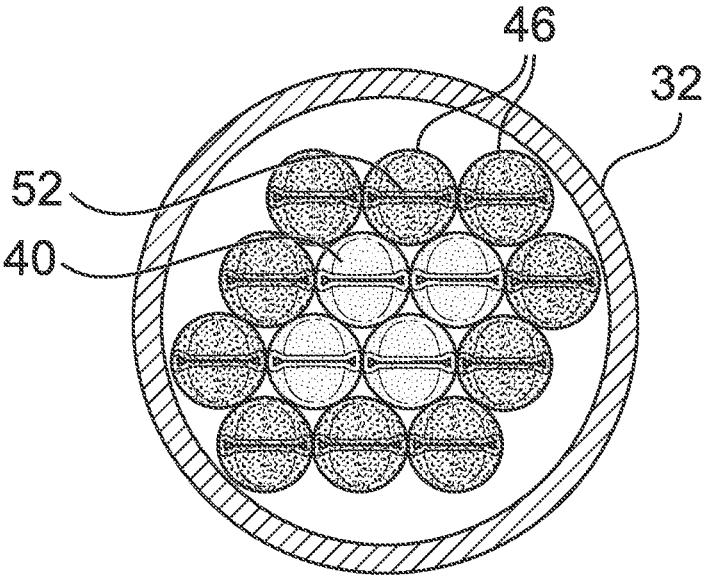
FIG. 5 is a cross sectional view of the face target insert and foam cover.
Figure 6:
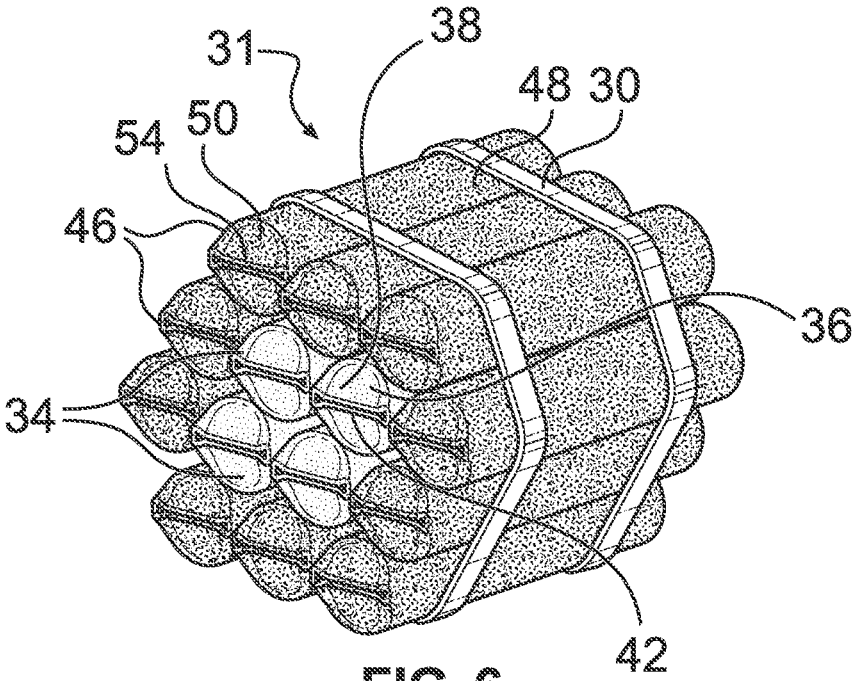
FIG. 6 is a perspective view of the face target insert [and] in isolation from foam cover.

By way of example, one embodiment of a reactive firearm target 10 is configured to release a visible airborne signature 12 upon a ballistic impact 14. The reactive firearm target 10 includes a main body 16 further comprising a main body upper opening 18 and a main body lower opening 20. An upper target insert 22 is inserted into the main body upper opening 18. A lower target insert 24 is inserted into the main body lower opening 20. The ballistic impact of either the upper target insert 22 or the lower target insert 24 causes the release of the visible airborne signature 12.

The upper target insert 22 further comprises a plurality of upper target inner inserts 34 surrounded by a plurality of upper target outer inserts 28. A plurality of upper insert bands 30 holds the plurality of upper target inner inserts 34 and the plurality of upper target outer inserts 28 in a first tight bundle 31. An upper insert housing 32 surrounds the first tight bundle 31.

Each upper target inner insert 34 further comprises an upper target inner insert tube 36 that is at least partially filled with a first powder 38 and crimped at an upper target inner insert tube first end 40 and an upper target inner insert tube second end 42. A projectile striking the upper target inner insert tube 36 pushes the first powder 38 from the upper target inner insert tube 36 creating a first visible airborne signature 44.

Each upper target outer insert 46 further comprises an upper target outer insert tube 48 that is at least partially filled with a second powder 50 and crimped at an upper target outer insert tube first end 52 and an upper target outer insert tube second end 54. A second projectile striking the upper target outer insert tube 48 pushes the second powder 50 from the upper target outer insert tube 48 creating a second visible airborne signature 56.

The lower target insert 24 further comprises a plurality of lower target inner inserts 58 surrounded by a plurality of lower target outer inserts 60. A plurality of lower insert bands 62 holds the plurality of lower target inner inserts 58 and the plurality of lower target outer inserts 60 in a second tight bundle 64. A lower insert housing 66 surrounds the second tight bundle 64.

Each lower target inner insert 68 further comprises a lower target inner insert tube 70 at least partially filled with the first powder 38 and crimped at a lower target inner insert tube first end 72 and a lower target inner insert tube second end 74. A projectile striking the lower target inner insert tube 70 pushes the first powder 38 from the lower target inner insert tube creating a first visible airborne signature.

Each lower target outer insert 76 further comprises a lower target outer insert tube 78 at least partially filled with the second powder 50 and crimped at a lower target outer insert tube first end and a lower target outer insert tube second end 82. A projectile striking the lower target outer insert tube 78 pushes the second powder 50 from the lower target outer insert tube 78 creating the second visible airborne signature 56.

In some embodiments, the reactive firearm target 10, the upper insert housing 32 and the lower insert housing 66 can be made from foam created into a desired shape utilizing a reaction injection molding technique. The master mold can provide a desired number of cylindrical voids while a separate mold can be used to replicate those voids specific characteristics relative to the placement on the reactive firearm target 10, creating an identical section of the reactive firearm target 10 that can be removed. The bundles can be made by using a light adhesive to bind together multiple paper tubes of the same length keeping the thickness closer to the thickness of the reactive firearm target 10 itself forming an empty hexagonal orientated bundle. This empty bundle can then be completely filled with the colorful powders made from cornstarch or another substance. The filled bundle is then placed into the appropriate mold assigned to their designated zone and filled with the same expansive foam that then encapsulates the bundle. Once the cartridge is secured inside the housing the housing can be handled without the powder spilling out. The result is a reactive firearm target 10 that is an exact physical replication seated within the void created in the body of the reactive firearm target 10.

The embodiment is then placed on a stand or approved supportive apparatus and engage it with the desired firearm. The target is aimed at the vital areas such as pelvic region, center of chest and head. Once the visual elements from these vital areas have been exhausted the bundle is easily removed by pushing it out from back to front and discarded.

The fresh bundle designated for the particular target and engagement of target is resumed.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A reactive firearm target configured to release a visible airborne signature upon a ballistic impact; the reactive firearm target comprising:

a main body further comprising a main body upper opening and a main body lower opening;

an upper target insert, inserted into the main body upper opening; wherein the upper target insert further comprises:

a plurality of upper target inner inserts surrounded by a plurality of upper target outer inserts; wherein each upper target inner insert further comprises a upper target inner insert tube at least partially filled with a first powder and crimped at an upper target inner insert tube first end and an upper target inner insert tube second end; wherein a projectile striking the upper target inner insert tube pushes the first powder from the upper target inner insert tube creating a first visible airborne signature;

a plurality of upper insert bands, holding the plurality of upper target inner inserts and the plurality of upper target outer inserts in a tight bundle;

an upper insert housing, surrounding the tight bundle; and a lower target insert, inserted into the main body lower opening.

2. The reactive firearm target of claim 1, wherein each upper target outer insert further comprises an upper target outer insert tube at least partially filled with a second powder and crimped at an upper target outer insert tube first end and an upper target outer insert tube second end;

wherein a projectile striking the upper target outer insert tube pushes the second powder from the upper target outer insert tube creating a second visible airborne signature.

3. The reactive firearm target of claim 2, wherein the lower target insert further comprises:

a plurality of lower target inner inserts surrounded by a plurality of lower target outer inserts;

a plurality of lower insert bands, holding the plurality of lower target inner inserts and the plurality of lower target outer inserts in a tight bundle;

a lower insert housing, surrounding the tight bundle.

4. The reactive firearm target of claim 3, wherein each lower target inner insert further comprises a lower target inner insert tube at least partially filled with the first powder and crimped at a lower target inner insert tube first end and a lower target inner insert tube second end;

wherein a projectile striking the lower target inner insert tube pushes the first powder from the lower target inner insert tube creating a first visible airborne signature.

5. The reactive firearm target of claim 4, wherein each lower target outer insert further comprises a lower target outer insert tube at least partially filled with the second powder and crimped at a lower target outer insert tube first end and a lower target outer insert tube second end;

wherein a projectile striking the lower target outer insert tube pushes the second powder from the lower target outer insert tube creating a second visible airborne signature.

6. A reactive firearm target configured to release a visible airborne signature upon a ballistic impact; the reactive firearm target comprising:

a main body further comprising a main body upper opening and a main body lower opening;

an upper target insert, inserted into the main body upper opening; wherein the upper target insert further comprises:

a plurality of upper target inner inserts surrounded by a plurality of upper target outer inserts; wherein each upper target inner insert further comprises:

a upper target inner insert tube at least partially filled with a first powder and crimped at an upper target inner insert tube first end and an upper target inner insert tube second end; wherein a projectile striking the upper target inner insert tube pushes the first powder from the upper target inner insert tube creating a first visible airborne signature;

an upper target outer insert tube at least partially filled with a second powder and crimped at an upper target outer insert tube first end and an upper target outer insert tube second end; wherein a projectile striking the upper target outer insert tube pushes the second powder from the upper target outer insert tube creating a second visible airborne signature;

a plurality of upper insert bands, holding the plurality of upper target inner inserts and the plurality of upper target outer inserts in a tight bundle;

an upper insert housing, surrounding the tight bundle; and a lower target insert, inserted into the main body lower opening; wherein the lower target insert further comprises:

a plurality of lower target inner inserts surrounded by a plurality of lower target outer inserts; wherein each lower target inner insert further comprises a lower target inner insert tube at least partially filled with the first powder and crimped at a lower target inner insert tube first end and a lower target inner insert tube second end;

a plurality of lower insert bands, holding the plurality of lower target inner inserts and the plurality of lower target outer inserts in a tight bundle; and a lower insert housing, surrounding the tight bundle;

wherein a projectile striking the lower target inner insert tube pushes the first powder from the lower target inner insert tube creating a first visible airborne signature.

7. The reactive firearm target of claim 6, wherein each lower target outer insert further comprises a lower target outer insert tube at least partially filled with the second powder and crimped ata lower target outer insert tube first end and a lower target outer insert tube second end;

wherein a projectile striking the lower target outer insert tube pushes the second powder from the lower target outer insert tube creating a second visible airborne signature.

* * * * *